US006450602B1

(12) United States Patent
Lubinsky et al.

(10) Patent No.: US 6,450,602 B1
(45) Date of Patent: Sep. 17, 2002

(54) ELECTRICAL DRIVE WAVEFORM FOR CLOSE DROP FORMATION

(75) Inventors: Anthony R. Lubinsky, Webster; Diane C. Freeman, Pittsford; Simon D. Yandila, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/679,931

(22) Filed: Oct. 5, 2000

(51) Int. Cl.[7] ..... B41J 29/38
(52) U.S. Cl. ..... 347/9; 347/8; 347/10
(58) Field of Search ..... 347/10, 11, 9, 347/8

(56) References Cited

U.S. PATENT DOCUMENTS

| | | | | | |
|---|---|---|---|---|---|
| 3,683,396 | A | | 8/1972 | Keur et al. | 347/75 |
| 4,368,474 | A | | 1/1983 | Togawa et al. | 347/76 |
| 4,491,851 | A | | 1/1985 | Mizuno et al. | 347/11 |
| 4,513,299 | A | | 4/1985 | Lee et al. | 347/15 |
| 4,652,153 | A | | 3/1987 | Kotsuzumi et al. | 400/56 |
| 4,972,211 | A | | 11/1990 | Aoki | 347/11 |
| 5,303,141 | A | | 4/1994 | Batchelder et al. | 364/149 |
| 5,360,276 | A | | 11/1994 | Petermann | 400/55 |
| 5,361,084 | A | | 11/1994 | Paton et al. | 347/15 |
| 5,428,375 | A | | 6/1995 | Simon et al. | 347/12 |
| 5,461,406 | A | | 10/1995 | Lorenze, Jr. et al. | 347/65 |
| 5,468,076 | A | | 11/1995 | Hirano et al. | 400/59 |
| 5,495,270 | A | | 2/1996 | Burr et al. | 347/10 |
| 5,610,636 | A | | 3/1997 | Hanabusa et al. | 347/8 |
| 5,796,416 | A | | 8/1998 | Silverbrook | 347/47 |
| 5,894,036 | A | | 4/1999 | Tylko | 427/279 |
| 5,901,425 | A | | 5/1999 | Bibl et al. | 29/25.35 |
| 5,980,132 | A | | 11/1999 | Kawai | 400/56 |
| 6,036,302 | A | | 3/2000 | Hotomi | 347/55 |
| 6,044,762 | A | | 4/2000 | DeBoer et al. | 101/466 |
| 6,059,392 | A | | 5/2000 | Park | 347/8 |
| 6,077,338 | A | * | 6/2000 | Wallstrom | 106/31.6 |
| 6,123,472 | A | * | 9/2000 | Elgee | 400/283 |
| 6,260,939 | B1 | * | 7/2001 | Shioya et al. | 347/15 |

FOREIGN PATENT DOCUMENTS

| | | | | |
|---|---|---|---|---|
| EP | 0 841 164 A1 | * | 5/1998 | B41J/2/045 |
| JP | 04085043 A | * | 3/1992 | B41J/2/01 |
| JP | 08300659 A | * | 11/1996 | B41J/2/205 |
| WO | WO 98/08687 | | 3/1998 | B41J/2/045 |

OTHER PUBLICATIONS

IBM Technical Disclosure Bulletin, vol. 29, No. 3, Aug. 1986, pp. 1412–1413, Capacitive Head Gap for Printers,.
Keyence LC–2430 Laser Displacement Sensor Tests on Film Hold Breadboard, Feb. 27 to 29, 1996.

* cited by examiner

*Primary Examiner*—John Barlow
*Assistant Examiner*—Alfred E Dudding
(74) *Attorney, Agent, or Firm*—Norman Rushefsky

(57) ABSTRACT

An inkjet printing apparatus and method of operating an inkjet printhead provides an inkjet orifice of the printhead that is located within a predetermined spacing of less than 1000 micrometers, and more preferably in a range of 50–500 micrometers for printing high resolution images. Electrical drive signals are provided to the printhead, the drive signals being adapted to enable the printhead to generate a droplet. In response to the drive signals, a free spherical droplet is formed between the orifice and a receiver member and deposits a droplet upon the receiver member substantially without presence of an attached or detached ligament of printing liquid that would otherwise provide an artifact mark on the receiver member.

23 Claims, 7 Drawing Sheets

ELECTRICAL DRIVE WAVEFORM FOR CLOSE DROP FORMATION

CROSS REFERENCE TO RELATED APPLICATIONS

This application is related to the following U.S. applications filed in the names of the inventors herein:

1. U.S. application Ser. No. 09/680,378 filed on Oct. 5, 2000 and entitled Apparatus and Method for Maintaining a Substantially Constant Closely Spaced-Working Distance Between An Inkjet Printhead and a Printing Receiver; and
2. U.S. application Ser. No. 09/679,761 filed on Oct. 5, 2000 and entitled Electrical Waveform for Satellite Suppression.

FIELD OF THE INVENTION

The present invention relates to imaging apparatus and methods, and more particularly relates to an imaging apparatus and method capable of ejecting liquid structures, which become spherical drops, within a short distance of travel from a nozzle orifice.

BACKGROUND OF THE INVENTION

Inkjet imaging devices use the controlled ejection of small droplets of liquid, to produce an image. Typically, the liquid is ejected through one or more nozzle orifices, which are produced in a nozzle plate. The pressure pulse, which ejects the liquid drop through the nozzle orifice, is typically produced by the application of an electrical drive waveform to an electromechanical transducer, as in a piezoelectric printhead; or to an electrothermal transducer, or resistor, as in a thermal printhead. The present invention concerns electrical drive waveforms particularly designed for printing images requiring precise placement of the liquid drops on the receiving medium, as for example in graphic arts printing. In graphic arts printing the liquid drops may be deposited on plates which are then used to selectively attract ink that is transferred to an ultimate receiver sheet such as paper. Examples of ink or printing liquids used with lithographic printing plates are described in U.S. Pat. No. 6044762, however the invention is not limited to the fluids mentioned only in that patent but applies to other fluids suited for ejection from an inkjet printhead as taught herein which are generally referred to herein as an ink or printing liquid.

It is known to use specially designed electrical drive waveforms in inkjet printing, to achieve particular purposes. For reference example, Lee, et. al., U.S. Pat. No. 4,513,299 discloses a waveform comprising a series of pulses to eject a series of subdrops from a nozzle, which then merge prior to hitting the receiver surface, thus producing a liquid drop of variable volume. Paton, et. al., U.S. Pat. No. 5,361,084 also discloses ejecting a series of subdrops to achieve variable liquid volumes, from an array of nozzles. Burr, et. al., U.S. Pat. No. 5,495,270 discloses an electrical drive waveform technique in which higher order vibrational modes of the liquid meniscus are excited, in order to produce smaller liquid drops from a fixed nozzle size. Aoki, in U.S. Pat. No. 4,972,211 discloses the addition of a secondary pulse, added to the electrical drive waveform, to suppress residual pressure fluctuations at the meniscus, allowing higher drop firing rates.

However, none of the above references address the problem of forming spherical liquid drops at a spatial position close to the nozzle plate. It is accordingly an object of the present invention to provide a method for forming such liquid drops, in order to allow increased accuracy of the placement of the drops onto a receiving medium.

SUMMARY OF THE INVENTION

It has been known to use an inkjet printhead to eject drops of liquid onto the surface of a receiving medium to produce an image, as shown in FIG. 1. However, a problem with the prior art has been that in actual practice, the jet of liquid that is produced may emerge in a direction that is not exactly perpendicular to the surface of the nozzle plate, as shown schematically in FIG. 1, and in a real example in the stroboscopic photomicrograph of FIG. 2. The jet misdirection may arise from a variety of physical causes, such as nozzle imperfections or deposits, and it results in an error in the final location of the ink drop, or dot, on the receiver, with respect to its desired location. These location errors can cause artifacts in the resulting images, such as visible bands. It would be desirable to decrease the working distance, or the distance between the nozzle plate and the receiver, in order to reduce the dot placement error. However, as seen for example in FIG. 2, the liquid object which is actually ejected from a nozzle typically consists of a liquid droplet connected to a long ligament or tail. If a receiver in relative motion to the printhead were placed close to the nozzle plate, as for example at the head position of the droplet-tail object in FIG. 2, then a mark on the receiver would be formed in the shape of a comet, which is undesirable.

It is, therefore, an object of the present invention to provide a method of producing spherical liquid drops close to an ejecting nozzle, in order to achieve a short working distance, and improved dot placement accuracy, in an inkjet imaging apparatus.

An advantage of such a method is that images free of artifacts such as visible bands, may be produced. Another advantage of such a method is that images requiring high resolution and accurate dot placement, such as graphic arts images, may be produced.

In accordance with a first aspect of the invention there is provided a method of operating an inkjet printhead comprising providing an inkjet orifice of the printhead located within a predetermined spacing of less than 1000 micrometers from a receiver member that is moving relative to the orifice so as to present different portions of the receiver member to the orifice at the predetermined spacing; providing electrical drive signals to the printhead, the electrical drive signals being adapted to enable the printhead to generate a droplet of a printing liquid; and forming a free spherical droplet of the printing liquid between the orifice and the receiver member and depositing the droplet of the printing liquid upon the receiver member.

In accordance with a second aspect of the invention, there is provided an inkjet printing apparatus comprising a printhead having an inkjet orifice within a predetermined spacing of less than 1000 micrometers from a receiver member that is moving relative to the orifice so as to present different portions of the receiver member to the orifice at the predetermined spacing; and a source of electrical drive signals to the printhead, the electrical drive signals being adapted to enable the printhead to generate a free spherical droplet of a printing liquid substantially without presence of an attached or detached ligament of the printing liquid that would otherwise form a mark or artifact on the receiver.

BRIEF DESCRIPTIONS OF THE DRAWINGS

While the specification concludes with the claims particularly pointing out and distinctly claiming the subject matter of the present invention, it is believed that the invention will be better understood from the following detailed description when taken in conjunction with the following drawings wherein:

Figure 4A:
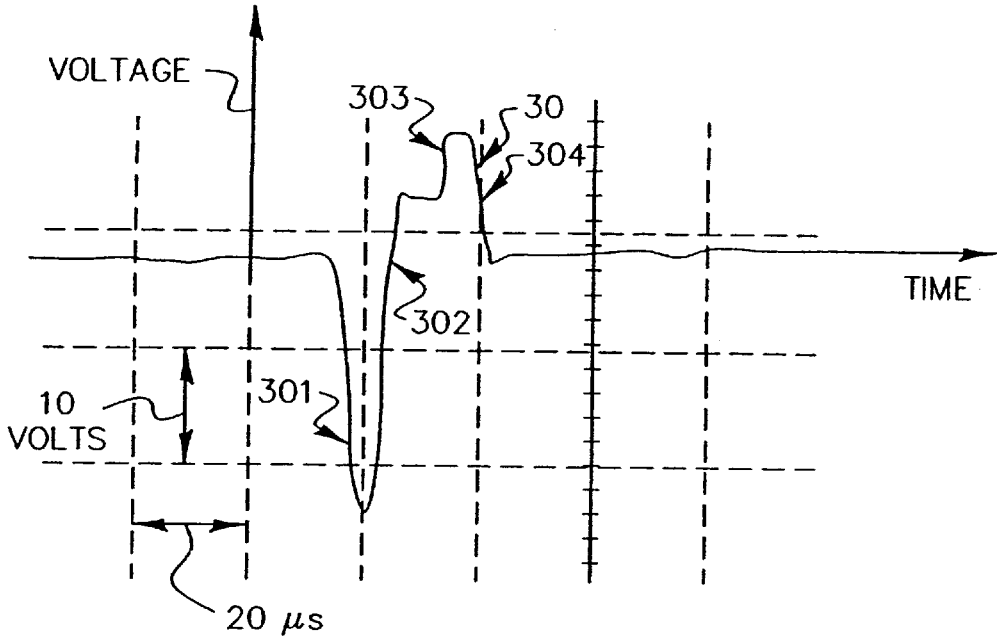

FIG. 4*a* is a graph of voltage versus time, illustrating the shape of an electrical drive waveform applied to a first known inkjet printhead in the prior art.

Figure 4B:
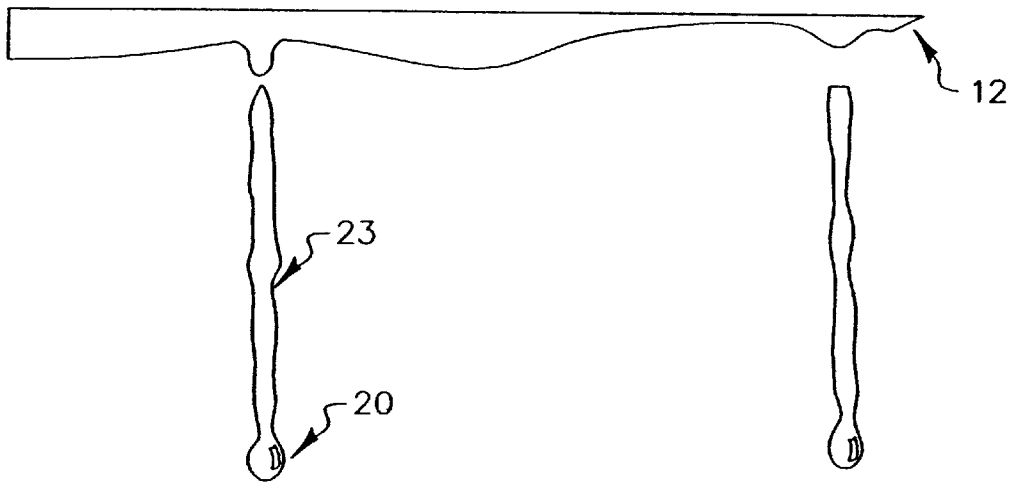

FIG. 4*b* is a photomicrograph of the liquid structures that are ejected, as a result of applying the electrical drive waveform in FIG. 4*a* to the first known inkjet printhead.

Figure 5A:
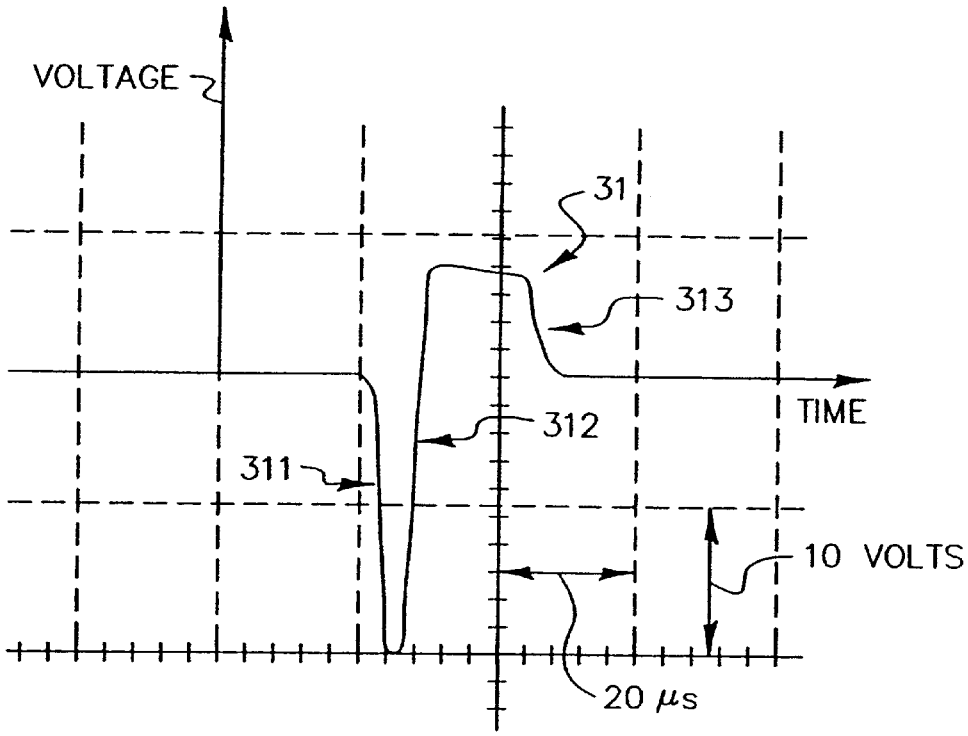

FIG. 5*a* is a graph of voltage versus time, illustrating the shape of an electrical drive waveform applied to the first known inkjet printhead in accordance with the present invention.

Figure 5B:
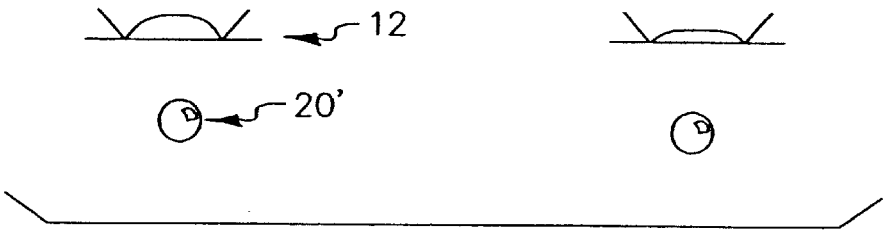

FIG. 5*b* is a photomicrograph of the liquid structures that are ejected, as a result of applying the electrical drive waveform in FIG. 5*a* to the first known inkjet printhead.

Figure 6:
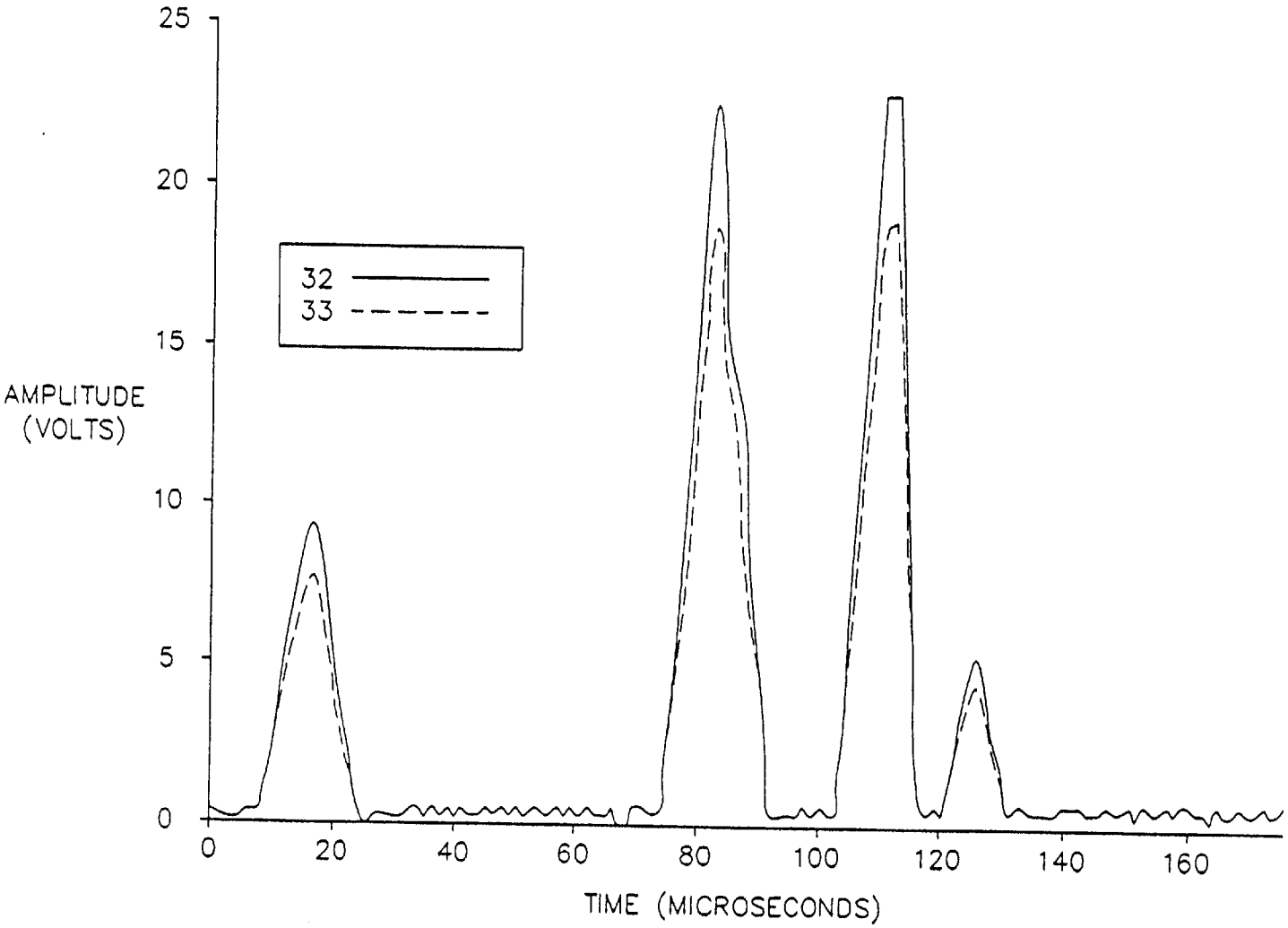

FIG. 6 is a graph of voltage versus time, illustrating the shape of an electrical drive waveform applied to a second known inkjet printhead according to the prior art (solid line) and a novel electrical drive waveform applied to the second known inkjet printhead in accordance with the invention (dotted line).

Figure 7A:
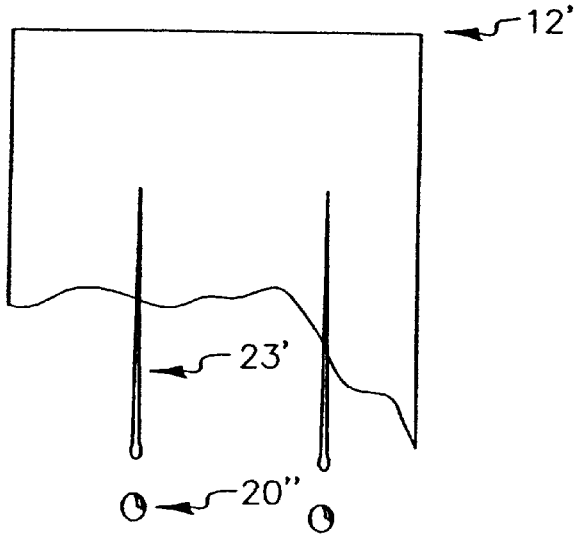

FIG. 7*a* is a photomicrograph of the liquid structures that are ejected, as a result of applying the prior art solid line electrical drive waveform in FIG. 6 to the second known inkjet printhead.

Figure 7B:
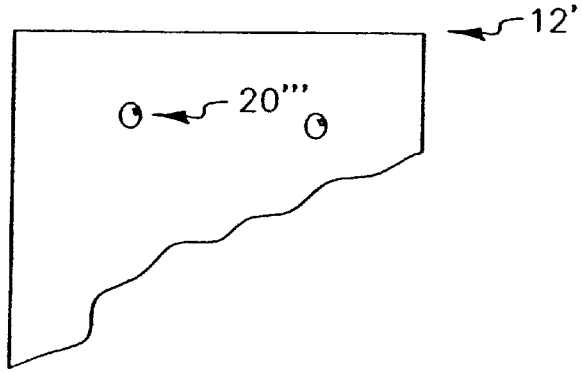

FIG. 7*b* is a photomicrograph of the liquid structures that are ejected in accordance with the invention, as a result of applying the novel (dotted line) electrical drive waveform in FIG. 6 to the second known inkjet printhead .

Figure 8:
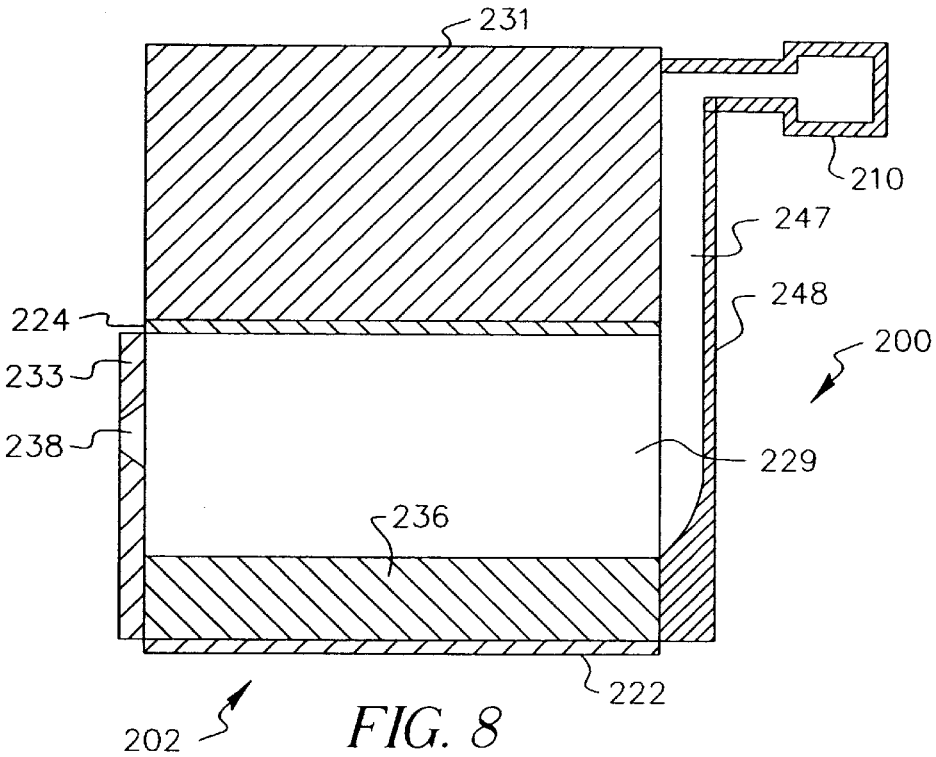
FIG. 8 (PRIOR ART)

FIG. 8 is a cross-sectional side view of an inkjet printhead structure showing in greater detail a single ink channel of the first known inkjet printhead.

Figure 9:
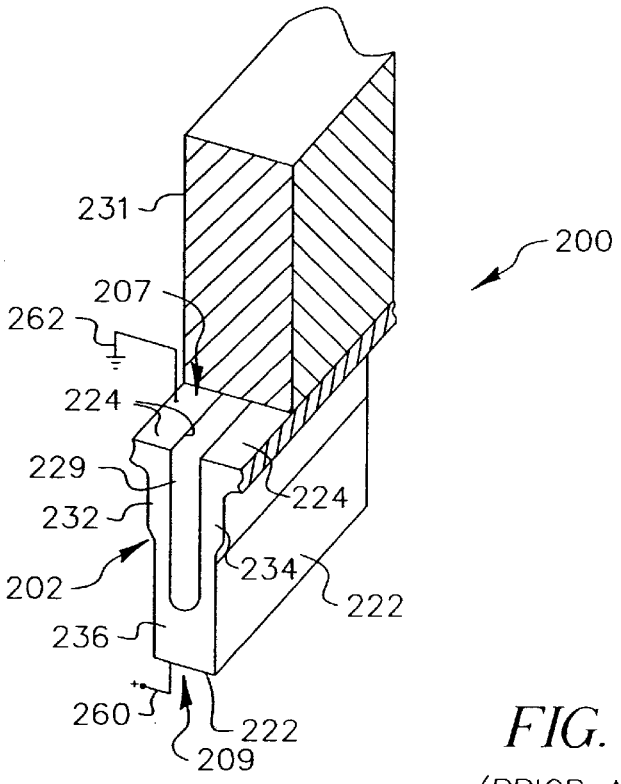
FIG. 9 (PRIOR ART)

FIG. 9 is a partial perspective view of the inkjet printhead structure of FIG. 8.

DETAILED DESCRIPTION OF THE INVENTION

The present description will be directed in particular to elements forming part of, or cooperating more directly with, an apparatus and method in accordance with the present invention. It is to be understood that elements not specifically shown or described may take various forms well known to those skilled in the art.

Figure 1:
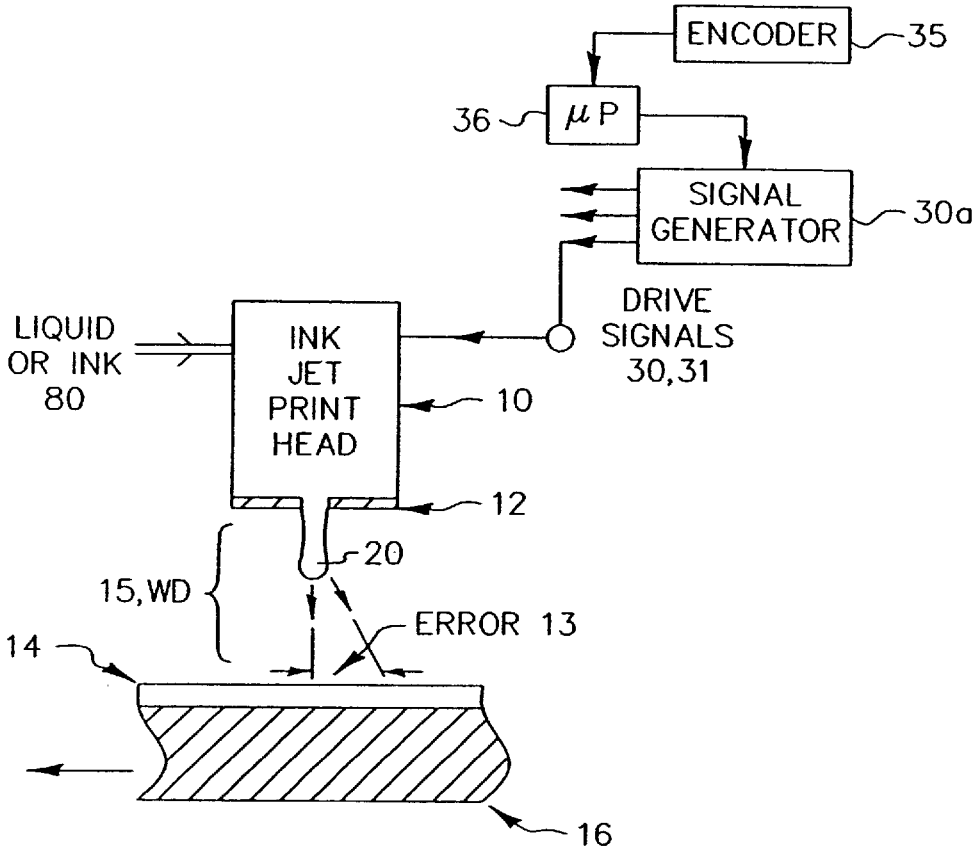
FIG. 1 is a simplified schematic view of an inkjet printhead, showing ejection of a liquid drop onto a receiver, and indicating schematically the behavior of a misdirected jet, and its associated error.

Therefore, referring to FIG. 1, an inkjet printhead 10 is shown, ejecting a liquid drop 20 through a nozzle plate 12, onto the surface 14 of a moving receiver medium 16. The inkjet printhead 10 is supplied with a printing liquid or ink 80 to be ejected, and is activated by electrical drive signals 30 from a signal generator as will be described below.

Figure 2:
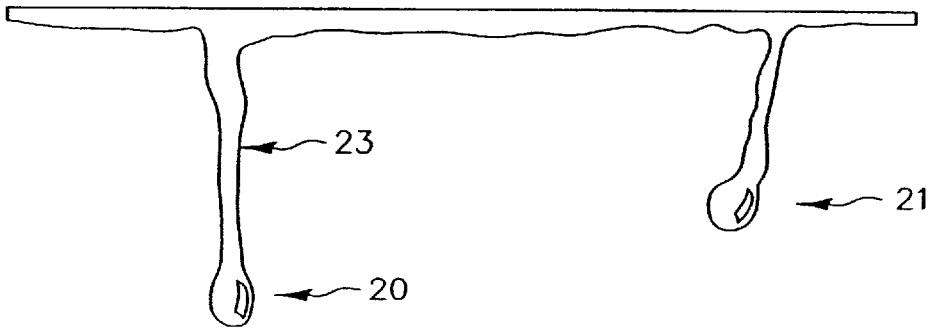
FIG. 2 is a photomicrograph of a normal drop ejection, and a misdirected drop ejection.

A problem in the prior art has been the undesirable ejection of misdirected drops, as shown schematically in FIG. 1. FIG. 2 shows a photomicrograph of a normally directed drop 20, and a misdirected drop 21. The misdirection in ejection may be due to any of a number of physical causes, including imperfections in the manufacture of nozzle plate 12, or deposits formed around the nozzle, with use. Misdirected drops result in errors in the location of drops, or dots, on the receiver surface 14. These dot placement location errors can cause undesirable artifacts in printed images, such as visible bands.

Figure 3:
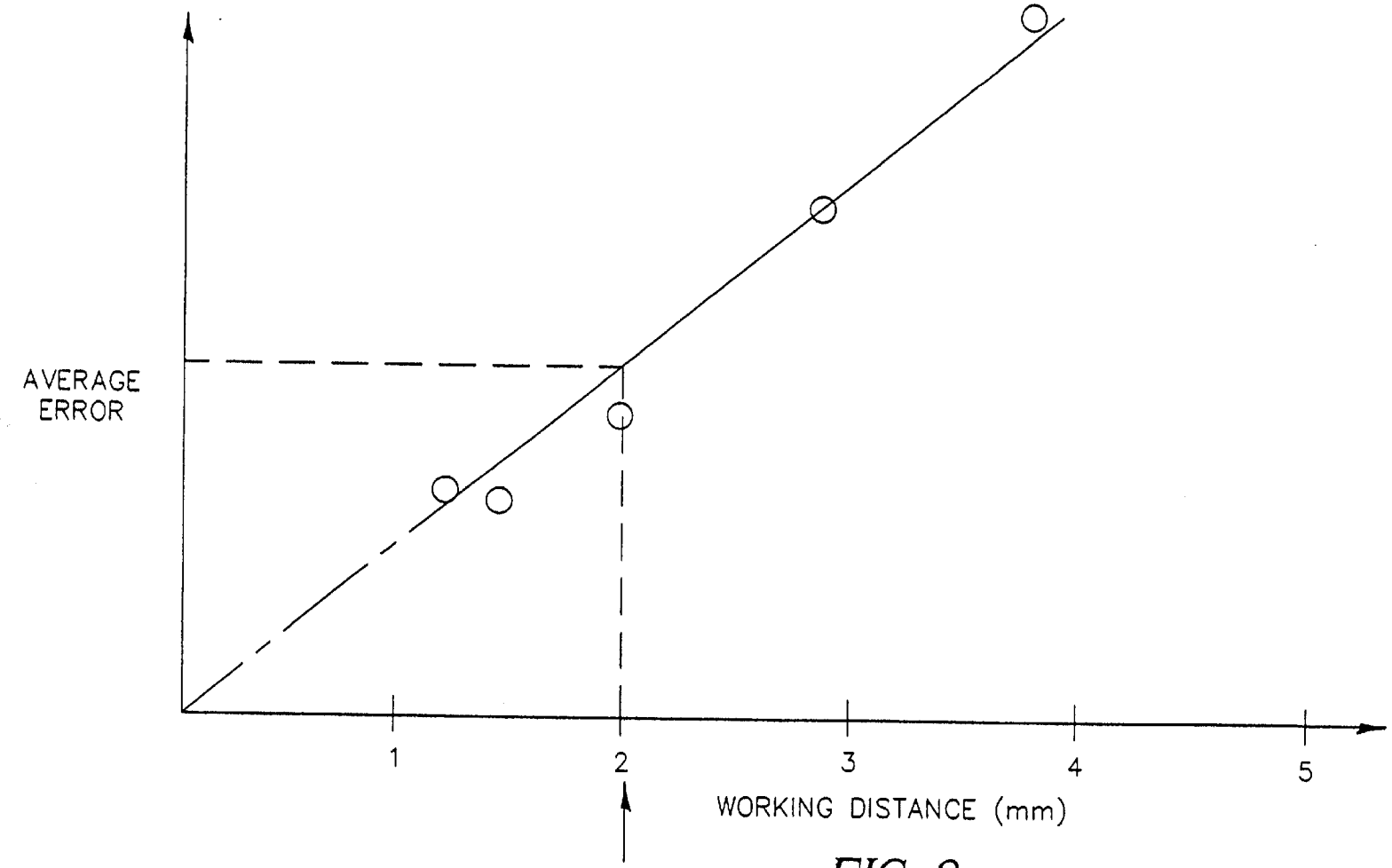
FIG. 3 (PRIOR ART)
FIG. 3 is a graph showing measured average dot placement error for a particular inkjet printhead, versus the working distance between the nozzle plate and the receiver.

As can be seen by geometry, referring to FIG. 1, reductions in the working distance 15 between the nozzle plate 12, and the receiver 14, will have the desirable effect of improving the dot placement error 13. This is shown further in FIG. 3, which shows the average error 13 measured for a particular printhead 10, versus the working distance 15. Referring still to FIG. 3, a typical working distance, as practiced in the prior art may be between 1 and 2 millimeters, resulting in a particular average error in the prior art, as shown. It would clearly be desirable to reduce the working distance substantially, thus reducing the dot placement error, as illustrated in FIG. 3. However, as illustrated by reference to FIG. 2, and also FIG. 4*b*, and also FIG. 7*a*, the liquid object typically ejected from the nozzle in the prior art typically consists of a liquid subdrop 20 connected to, or followed by a long ligament or tail, 23. If a receiver 16 in relative motion to the printhead 10 were placed close to the nozzle plate 14, as for example at the head position of the droplet-tail object in FIG. 2 or 4*b* or 6*b*, then a mark on the receiver would be formed in the shape of a comet, which is undesirable. Therefore, it is desirable to eject a fluid structure which becomes a spherical liquid drop, close to the nozzle plate 12. It would be desirable to form a spherical droplet that is used for recording a pixel of an image wherein the receiver member to be printed is closer than 1000 micrometers, preferably in the range of 50 to less than 1000 micrometers, and more preferably less than 500 micrometers and still more preferably in the range of 50 to less than 500 micrometers from the nozzle plate 12.

Referring to FIG. 4*a*, there is shown an electrical drive signal 30 used for driving an inkjet printhead 10, in the prior art. The electrical signal may be produced using a signal generator and amplifier, by methods well known to those skilled in the art. The inkjet printhead may contain a piezoelectric actuator, whose electrodes are connected to receive the drive signal 30. The electrode polarities in the present example are chosen such that the downward-going voltage edge 301, in FIG. 4*a*, causes an outward mechanical expansion of the actuator, drawing liquid 80 into the printhead 10. The upward-going voltage edges 302 and 303 cause inward compressions of the actuator, expelling liquid from the nozzles. Finally, the downward-going edge returns the actuator to its original state, in readiness for the next actuation. The piezo actuator responds not to absolute voltage, but to changes in voltage, or "edges." In this example the firing edges follow the filling edge in time in a-"fill and shoot" mode. For this inkjet channel the channel length L was about 5 millimeters and the value of 4 L/c is about 13.34 microseconds. Firing efficiency in general depends on the time delay between the filling and firing edges, and the most efficient value for the delay in turn depends on the channel length, or acoustic resonant frequency. Choosing an overall pulse width is an initial step in constructing a waveform, however as will be noted below special tuning of this pulse width can provide significant advantages in obtaining spherical droplets that are created within a short distance after being ejected from the orifice thus providing printed drops that are generally free of artifacts such as visible bands because they are formed free of trailing ligaments or tails.

Referring to FIG. 4*b*, there is shown a photomicrograph of the liquid structures ejected from the nozzle plate 12, upon application of the prior art electrical drive waveform 30. It is observed that the liquid structure comprises a subdrop 20, connected to a long ligament or tail 23.

Now referring to FIG. 5*a*, there is shown an electrical drive waveform 31, according to one embodiment of the present invention. As before, when the electrodes of a piezoelectric actuator are connected to receive drive waveform 31, the initial downward-going voltage edge 311 causes a mechanical expansion of the actuator, which draws liquid 80 into printhead 10. In the present example of FIG. 5*a*, a single upward-going voltage edge 312 is then applied, after a shorter time delay, than in the prior art case 30. Finally, a downward edge 313 returns the actuator to its original state Referring to FIG. 5*b*, there is shown a photomicrograph of the liquid structures ejected from the nozzle plate12, upon application of the present invention electrical drive waveform 31 to the same printhead 10 and liquid 80 as illustrated in FIG. 4*b*. It is observed that free spherical drops 20' are formed, in this case within 50–75 microns of the nozzle plate surface 12. The drops produced by this printhead are about 25 picoliters in volume and about 36 microns in diameter and the speed of the drops is generally around 5 meters per second. Density of the ink or printing liquid used is about 1.0–1.1 grams/cc and the viscosity is in the range of 2–6 cp and surface tension of the ink or writing liquid used is in the range of 32–36 dynes/cm. In the event that the printing liquid is heated in the printhead, the above values for the ranges of density, surface tension and viscosity are to be determined at the temperature of the printing liquid in the printhead. Surface tension of the printing liquid is a static measurement and may be measured with a Kruss Pressure Tensiometer. The viscosity of the printing liquid may be measured using a Rheolyst AR 1000 Rheometer from TA Instrument. In order to provide for high resolution printing at a desired resolution of 1200–2400 dpi it is desirable to have a preferred range of free printing liquid droplet size be 0.5–30 picoliters, however the invention in its broader aspects is suitable also for droplet sizes of greater than 30 picoliters.

Referring now to FIGS. 6 and 7*a*, there is shown in FIG. 7*a* the result of applying a prior art waveform 32, shown in FIG. 6(solid line), to a different inkjet printhead, in which the polarities of the receiving actuator electrodes are reversed. It is observed that a liquid structure consisting of a subdrop 20", followed by a long ligament 23', is formed by ink expelled from orifice 12'. The printhead used in this example is an Epson 900. The waveform shown comprises an initial lower voltage pulse followed by a pair of higher voltage pulses, with a peak voltage V1 of one of the higher voltage pulses being 23 volts, and then followed by a lower voltage pulse. The waveform shown in solid line in FIG. 6 is the standard shape for ejecting a single droplet from the Epson printhead noted. The ink or printing liquid used had the same physical characteristics of ranges described above.

Referring to FIGS. 6 and 7*b*, there is shown in FIG. 7*b* the result of applying an electrical drive waveform 33, modified according to the present invention, to the same printhead 10 and fluid 80 as described for creation of the droplet with ligament illustrated in FIG. 7*a*. In the present example the drive waveform is modified by keeping the shape constant, but reducing the peak voltage magnitude V2 so that it is less than V1. In this example, V2 was 19 volts and V1 was 23 volts. Referring to FIG. 7*b*, it is observed that spherical drops 20'" of 10 picoliters volume are formed, close to nozzle plate 12'.

FIG. 8 is a cross-sectional slide view of a single channel of an inkjet printhead structure 200 for a piezoelectric inkjet printer constructed in accordance with the description provided in U.S. Pat. 5,901,425, the contents of which relating to such structure are incorporated herein by reference and which is further descriptive of the printhead structure of FIG. 1. Printhead structure 200 comprises a printhead transducer 202, formed of piezoelectric material, into which is cut an ink channel 229. The ink channel 229 is bordered along one end with a nozzle plate 233 having an orifice 238 defined therethrough. A rear cover plate 248 is suitably secured to the other end of ink channel 229. A base portion 236 of the printhead transducer 202 forms the floor of the ink channel 229, while an ink channel cover 231 is secured to the upper opening of the printhead transducer 202. Ink channel 229 is supplied with ink from an ink reservoir 210 through ink feed passage 247 in rear cover plate 248. Actuation of the printhead transducer 202 results in the expulsion of ink drops from ink channel 229 through the orifice 238 in nozzle plate 233.

Referring to FIG. 9, the printhead transducer of FIG. 8 is shown in greater detail. The printhead transducer comprises a first wall portion 232, a second wall portion 234, and a base portion 236. The upper surfaces of the first and second wall portions 232 and 234 define a first face 207 of the printhead transducer 202, and the lower surface of the base portion 236 defines a second opposite face 209 of the printhead transducer 202. Ink channel 229 is defined on three sides by the inner surface of the base portion 236 and the inner wall surfaces of the wall portions 232 and 234, and is an elongated channel cut into the piezoelectric material of the printhead transducer 202, leaving a lengthwise opening along the upper first face of the printhead transducer 202. One end of ink channel 229 is closed off by a nozzle plate 233 while the other end is closed off by rear cover plate 248. A metallization layer 224 coats the inner surfaces of ink channel 229 and is also deposited along the upper surfaces of the first wall portion 232 and second wall portion 234. An ink channel cover 231 is bonded over the first face of the printhead transducer 202, to close off the lengthwise lateral opening in the ink channel 229. A second metallization layer 222 coats the outer surfaces of the base portion 236, and also extends approximately half way up each of the outer surfaces of the first and second wall portions 232 and 234.

The metallization layer 222 defines an addressable electrode 260, which is connected to an external signal source to provide electrical drive signals to actuate the piezoelectric material of printhead transducer 202. The metallization layer 224 defines a common electrode 262 which is maintained at ground potential. The piezoelectric material forming the printhead transducer 202 is PZT, although other piezoelectric materials may also be employed in the present invention.

The printhead of FIGS. 8 and 9 works upon the principal of the piezoelectric effect, where the application of an electrical signal across certain faces of piezoelectric material produces a corresponding mechanical distortion or strain in that material. In general, an applied voltage of one polarity will cause material to bend in the first direction, and an applied voltage of the opposite polarity will cause material to bend in the second direction opposite that of the first. Application of a positive voltage to electrodes 260 results in movement of the base portion 236 and wall portions 232 and 234 of the printhead transducer inward, toward the channel 229, resulting in a diminishment of the interior volume of the ink channel 229. Upon application of negative voltage to the addressable electrode 260 there is a resulting net volume increase in the interior volume of the ink channel 229.

In operation, the application of electrical drive signals to the addressable electrode 260 of the printhead transducer 202 causes a mechanical movement or distortion of the walls of ink channel 229, resulting in a volume change within the channel 229. This change in volume within the channel 229 generates an acoustic pressure wave within the ink channel 229, and this pressure wave within the channel 229 provides energy to expel ink from orifice 238 of printhead structure 220 onto a print medium. This particular printhead operates primarily in the shear mode and there are two orifices-one in the nozzle plate (35 micrometers at the outside, with a tapered shape to 75 micrometers at the back) and one at the channel inlet.

In accordance with the invention described herein, a parameter of the drive signal for example amplitude, frequency, and/or shape of the applied electrical waveform is adjusted to provide a free spherical droplet expelled from the printhead 10 to the surface of a receiver sheet or member that is positioned at a spacing of less than 1000 micrometers, preferably in the range of 50 to less than 1000 micrometers, and more preferably less than 500 micrometers from the orifice of the printhead and which is moving relative to the orifice. Still more preferably, the spacing between the orifice and the receiver member is of the order of 50 to less than 500 micrometers.

The signals described herein may be provided by output from a signal generator 30*a* that is modified so as to be adapted or tuned to provide a free spherical droplet in the space between the orifice and the closely positioned receiver member. The term "free" implies not connected to orifice or receiver member. The signals from the signal generator 30*a* may be amplified and applied to the respective printhead transducer's to eject a droplet at a specific location from a specific ink jet orifice. The printhead may also include a switch array having a series of digitally controlled switches which selectively control which individual channels of the array of printhead channels will be permitted to receive an actuation signal for expelling an ink jet drop. Typically, signals from an external encoder 35 are provided to a microprocessor 36 which outputs control signals to the signal generator linked to the motion of the printhead so that the expelled ink drops are ejected with optimal timing to impact a print medium at the correct position.

Reference is made above to commonly assigned U.S. application Ser. No. 09/680,378, filed in the name of Anthony R. Lubinsky et al. In this aforementioned U.S. application, description is made of an apparatus and method for maintaining a substantially constant closely spaced working distance between an ink jet printhead's orifice(s) and a printing receiver or medium, and the contents of such description are incorporated herein by reference. Typically, the printheads described herein include a plurality of orifices that may be substantially simultaneously energized. The printheads described herein are suited for graphic arts printing in which the spatial frequency of the microdots forming the image may be very high, for example 1200–2400 dpi or higher. In using the printheads, the ink receiving medium or element may be moved or translated in a first direction y while the printhead may be moved or scanned across the receiving medium or element in a direction x that is perpendicular to y. Spacing between the orifice and the ink receiving medium is in a direction z that is perpendicular to the plane xy. Velocity of relative movement of the orifice vis-a-vis the receiving medium can range up to one meter per second.

It has thus been shown that electrical drive waveforms can be provided which cause the ejection of free spherical liquid drops close to the nozzle plate of an inkjet printhead, allowing closer working distances, and improved drop placement accuracy. In one embodiment, the shape of the electrical drive waveform is changed, from the prior art. In another embodiment, the shape of the drive waveform is kept constant, and the voltage magnitude is changed, from the prior art. It has experimentally been found possible to provide drive waveforms which are tuned or specially adapted to cause close drop formation when ejecting fluid-like (i.e., liquid) inks for printing, and also when ejecting fluids which may be used for producing printing plates. Although the invention has been described primarily with reference to piezoelectric actuated ink jet printheads, adjustment to driving signals may also be provided to other types of inkjet printheads such as electrothermal printheads. The printheads may be of the drop-on demand type as described herein or the continuous type.

While different embodiments, applications and advantages of the invention have been shown and described with sufficient clarity to enable one skilled in the art to make and use the invention, it would be equally apparent to those skilled in the art that many more embodiments, applications and advantages are possible without deviating from the inventive concepts disclosed, described, and claimed herein. The invention, therefore, should only be restricted in accordance with the spirit of the claims appended hereto or their equivalents, and is not to be restricted by specification, drawings, or the description of the preferred embodiments.

The invention has been described in detail with particular reference to certain preferred embodiments thereof, but it will be understood that variations and modifications can be effected within the spirit and scope of the invention.

What is claimed is:

1. A method of operating an inkjet printhead comprising:

providing an inkjet orifice of the printhead located within a predetermnined spacing of less than 500 micrometers from a receiver member that is moving relative to the orifice so as to present different portions of the receiver member to the orifice at the predetermined spacing;

providing electrical drive signals to the printhead, the electrical drive signals being adapted to enable the printhead to generate a droplet of a printing liquid wherein the shape, amplitude and/or frequency of the drive signals are adapted to generate a free spherical droplet, the droplet having a volume of less than 30 picoliters; and forming the free spherical droplet of the printing liquid between the orifice and the receiver member wherein the droplet is formed of a printing liquid having a density of 1.0–1.1 grams/cc, a surface tension in the range of 32–36 dynes/cm and a viscosity in the range of 2–6 cp;and depositing the droplet upon the receiver member.

2. The method of claim 1 wherein the predetermined spacing is in the range of 50 to less than 500 micrometers.

3. The method of claim 1 and wherein the receiver member is a printing plate and liquid droplets deposited on the printing plate are then used to selectively attract ink to the plate and the ink is then printed on an ultimate receiver sheet.

4. A method of operating an inkjet printhead comprising:

providing an inkjet orifice of the printhead located within a predetermined spacing of less than 500 micrometers from a receiver member that is moving relative to the orifice so as to present different portions of the receiver member to the orifice at the predetermined spacing;

providing electrical drive signals to the printhead, the electrical drive signals being adapted to enable the printhead to generate a droplet of a printing liquid; and forming a free spherical droplet of the printing liquid between the orifice and the receiver member wherein the droplet is formed of a printing liquid having a density of 1.0–1.1 grams/cc,a surface tension in the range of 32–36 dynes/cm, and a viscosity in the range of 2–6 cp; and depositing the droplet upon the receiver member.

5. The method of claim 4 wherein the printhead includes a printhead channel that is actuated with a piezoelectric transducer.

6. The method of claim 5 wherein the predetermined spacing is in the range of 50 to less than 500 micrometers.

7. The method of claim 1 wherein the printhead includes a printhead channel that is actuated with a piezoelectric transducer.

8. The method of claim 4 and wherein the receiver member is a printing plate and liquid droplets deposited on the printing plate are then used to selectively attract ink to the plate and the ink is then printed on an ultimate receiver sheet.

9. A method of operating an inkjet printhead comprising:

providing an inkjet orifice of the printhead located within a predetermined spacing that is in the range of 50 micrometers to less than 500 micrometers from a receiver member that is moving relative to the orifice so as to present different portions of the receiver member to the orifice at the predetermined spacing;

providing electrical drive signals to the printhead, the electrical drive signals being adapted to enable the printhead to generate a droplet of a printing liquid; and forming a free spherical droplet of the printing liquid between the orifice and the receiver member and depositing the droplet upon the receiver member.

10. The method of claim 9 wherein the droplet is formed of a printing liquid having a density of 1.0–1.1 grams/cc,a surface tension in the range of 32–36 dynes/cm, and a viscosity in the range of 2–6 cp.

11. The method of claim 9 and wherein the receiver member is a printing plate and liquid droplets deposited on the printing plate are then used to selectively attract ink to the plate and the ink is then printed on an ultimate receiver sheet.

12. An inkjet printing apparatus comprising:

a printhead having an inkjet orifice within a predetermined spacing of less than 500 micrometers from a receiver member that is moving relative to the orifice so as to present different portions of the receiver member to the orifice at the predetermined spacing; and a source of electrical drive signals to the printhead, the electrical drive signals being adapted to enable the printhead to generate a free spherical droplet of a printing liquid substantially without presence of an attached or detached ligament of printing liquid that would otherwise form a mark on the receiver member.

13. The apparatus of claim 12 wherein an ink delivery channel communicates with the orifice and the channel includes a printing liquid having a density of 1.0–1.1 grams/cc, a surface tension in the range of 32–36 dynes/cm, and a viscosity in the range of 2–6 cp.

14.The apparatus of claim 13 wherein the delivery channel is formed of or includes a piezoelectric transducer which is responsive to the drive signals.

15. The apparatus of claim 12 and wherein a printing liquid delivery channel communicates with the orifice and the channel includes a printing liquid having a density of 1.0–1.1 g/cc, a surface tension of 32–36 dynes/cm, and a viscosity of 2–6 cp.

16. The apparatus of claim 15 wherein the delivery channel is formed of or includes a piezoelectric transducer which is responsive to the drive signals.

17. The apparatus of claim 12 wherein the predetermined spacing is in the range of 50 to less than 500 micrometers.

18. The apparatus of claim 17 and wherein a printing liquid delivery channel communicates with the orifice and the channel includes a printing liquid having a density of 1.0–1.1 grams/cc, a surface tension in the range of 32–36 dynes/cm and a viscosity in the range of 2–6 cp.

19. The apparatus of claim 18 wherein the printing liquid delivery channel is formed of or includes a piezoelectric transducer which is responsive to the drive signals.

20. The apparatus of claim 12 and wherein the receiver member is a lithographic printing plate.

21. A method of operating an inkjet printhead comprising:

providing an inkjet orifice of the printhead located within a predetermined spacing range of 50 to less than 500 micrometers from a receiver member that is moving relative to the orifice so as to present different portions of the receiver member to the orifice at the predetermined spacing;

providing electrical drive signals to the printhead, the electrical drive signals being adapted to enable the printhead to generate a droplet of an ink; and forming a free spherical droplet of the ink between the orifice and the receiver member and depositing the droplet upon the receiver member substantially without presence of an attached or detached ligament that would otherwise mark the receiver member.

22. The method of claim 21 and wherein the spherical droplet has a volume of 0.5 to 30 picoliters.

23. The method of claim 21 wherein the droplet is formed of an ink having a density of 1.0–1.1 grams/cc, a surface tension in the range of 32–36 dynes/cm and a viscosity in the range of 2–6 cp.

* * * * *